United States Patent [19]

Ishikawa

[11] Patent Number: 4,484,412

[45] Date of Patent: Nov. 27, 1984

[54] METHOD AND APPARATUS FOR CUTTING HARD AND BRITTLE MATERIAL USING SYSTEM FOR APPLYING VIBRATION IN TWO DIRECTIONS

[76] Inventor: Ken-ichi Ishikawa, 2-66-2, Nukatani, Kanazawa-shi, Ishikawa-Ken, Japan

[21] Appl. No.: 398,591

[22] Filed: Jul. 15, 1982

[30] Foreign Application Priority Data

Jul. 27, 1981 [JP] Japan ..... 56-117532

[51] Int. Cl.[3] ..... B24B 25/00

[52] U.S. Cl. ..... 51/157; 51/59 R; 83/701

[58] Field of Search ..... 51/59 R, 59 SS, 151, 51/283 R, 157, 292, 60, 64, 65, 58; 125/12, 16 R, 30 R; 83/701; 269/254 R; 366/108, 111

[56] References Cited

FOREIGN PATENT DOCUMENTS 50086 4/1977 Japan ..... 51/59 SS 701824 12/1979 U.S.S.R. ..... 125/16 R

*Primary Examiner*—Frederick R. Schmidt
*Assistant Examiner*—Matthew D. Daschel
*Attorney, Agent, or Firm*—McGlew and Tuttle

[57] ABSTRACT

A method and apparatus for cutting a hard and brittle material using a system for applying vibration in two directions with a strip-shaped flat cutting tool. The material to be cut is caused to make a reciprocating motion of a given stroke length together with a first small-amplitude, low frequency vibration in directions parallel to the reciprocating motion. Concurrently with this, a second small-amplitude vibration is applied also to the material to be cut in directions parallel to the cutting direction of the cutting tool into the material and in synchronism with the first small-amplitude vibration. Meanwhile, cutting pressure is applied to the cutting tool to a desired degree with a cutting fluid containing abrasive grain supplied to the cutting part of the material during the process of cutting.

5 Claims, 6 Drawing Figures

1
2
3
4
6
6'
7
8
9
10
11
12
13
14
15
16
17
18
19
20
21
22
23
24
24
26
27
S
θ
$V_H$
$V_V$

METHOD AND APPARATUS FOR CUTTING HARD AND BRITTLE MATERIAL USING SYSTEM FOR APPLYING VIBRATION IN TWO DIRECTIONS

BACKGROUND OF THE INVENTION

1. Field of the Invention

This invention relates to a method and an apparatus for cutting a hard and brittle material to be worked, such as ceramics, a silicon single crystal material and a rock crystal material, with a high degree of precision and high efficiency.

2. Description of the Prior Art

Conventional methods for cutting hard and brittle materials such as ceramics, silicon single crystals, rock crystals, etc. include a method in which the material to be cut is cut by rotating a diamond wheel which is prepared with grains of diamond buried in a thin disc at a high speed and by pushing the rotating disc against the material to be cut; and a method in which either a tool of a linear shape such as wire or a thin strip-shaped cutting tool called a multi-blade is caused to make a reciprocating motion at a very low frequency not exceeding several Hz and at a stroke length of one hundred mm or thereabout through a suitable guide while, at the same time, a machining or work liquid containing abrasive grains is continuously supplied to the cutting part of the material during a cutting process. In the case of the former in which a high speed rotating diamond cutter is employed, the work efficiency is high. However, the use of the diamond wheel necessitates an after-work process such as lapping because of saw marks produced on the cut surface of the material by the diamond wheel. Besides, the diamond wheel is expensive and thus has much affected the cost of the product thus obtained. In the latter method where the cutting work is to be accomplished by causing a thin cutting tool to make a reciprocating motion with the supply of a grain suspension, the work efficiency is very low though the precision of the cut surface of the material might be satisfactory. Besides, with the latter method employed, uneven distribution of the cutting powder grains within the suspension has often resulted in a poor finishing surface.

Meanwhile, there has been developed a method as disclosed in Japanese patent application Laid-Open No. 51-123987 in which thin wire is wound round a plurality of multi-groove pulleys; the wire is caused to make a reciprocating motion by a drive mechanism disposed outside; further, a vibration is transmitted to the wire through the pulleys; and during a cutting process, a hard and brittle material is cut into thin plates or sliced with a mixture consisting of grains of cutting powder and oil supplied to the cutting part of the material to be cut. In this method, however, inadequate arrangement of the cutting pulleys tends to result in breakage of the wire which is employed as cutting tool. This lowers the work efficiency. Further, since an excessively large tension cannot be applied to the wire, it is inevitable that the wire is curved during the cutting work on the material. This results in fine streaky scars on the cut surface or the material. Besides, where the wire is a tungsten wire, it is so twisted when it is rewound that reuse of it is hardly possible. This causes a great increase in cost.

In an attempt to obviate these shortcomings of the methods of the prior art, the present inventors conducted studies and eventually came up with a new method of cutting a hard and brittle material. This method was characterized in that a low frequency vibration in the direction of the cutting edge of a strip-shaped flat cutting tool and a reciprocating motion of a given stroke length in the same direction are simultaneously imparted to the cutting tool in a superimposing manner. This method has been disclosed in Japanese patent application Laid-Open No. 52-81190. Through further studies, however, the new method has been presenting the following problem when it is to be embodied in a practical cutting apparatus: A reciprocating motion and a small-amplitude vibration are imparted to a strip-shaped flat cutting tool in accordance with the new method as disclosed in the previous patent application. However, the impartment of the reciprocating motion and the low frequency vibration to the strip-shaped flat cutting tool during cutting work necessitates, for actual application of the method, mounting of the cutting tool on a rigid tool frame with tension applied to the cutting tool up to a value close to an endurable limit thereof in order to have the thin flat cutting tool apparently serve as a rigid body. This necessitates provision of a stretching block for mounting the cutting tool in a stretched state. Such arrangement then results in a considerably large weight, say 50 kg f, of the tool mounting frame. Then, the impartment of a vibration up to a maximum value of 200 Hz to the tool frame is uneconomical in respect of the capacity of a vibration exciter and the rigidity of the machine. The method thus tends to be impracticable. Assuming that the weight of the tool frame W is 50 kg f; the cycle of vibration or oscillation frequency f is 60 Hz; the amplitude of the vibration a is 1 mm; and a harmonic vibration x is asin $2\pi$ ft, if such a vibration is to be applied to the tool frame, a calculated gravity acceleration is as follows:

Gravity acceleration $g = 9800$ mm/sec$^2$

Therefore, the maximum value of an inertia force F max produced by the vibration can be obtained as shown below:

$$F\max = \frac{W}{g}\ddot{x}_{max}$$

$$= \frac{W}{g}\, a\,(2\pi f)^2$$

$$= \frac{50}{9800} \times 1 \times (2\pi \times 60)^2$$

$$\approx 725 \text{ kg}f$$

Meanwhile, assuming that the weight of the material to be cut together with the material mounting mount is $W' = 3$ kg f, the maximum value of an inertia force thereof F' max can be obtained in the following manner:

$$F'\max \approx \frac{W}{g}\, a\,(2\pi f)^2 = 43.5 \text{ kg}f$$

In view of the above, it may be considered impossible to impart a vibration to the tool frame in terms of the rigidity of the whole apparatus and economy.

To solve this problem, the present inventors have further invented a practicable improvement over the above-stated invention for which the above-stated patent application was filed (Japanese patent application Laid-Open No. 52-81190). For this improvement another patent application has been filed under Japanese patent application No. 53-161780. In accordance with this invention, a reciprocating motion and a small-amplitude vibration are arranged to be imparted to the material to be worked on, which is of a smaller mass than a tool mounting frame, both in directions in parallel with the cutting edge of a flat cutting tool in a superimposed manner. The improvement has been found not only capable of solving the above-stated problem but also capable of improving the precision of the cut surface and the work efficiency.

SUMMARY OF THE INVENTION

It is a general object of the present invention to provide a method and an apparatus for further improvement over the above-stated improvement disclosed in Japanese patent application No. 53-161780.

It is a more specific object of this invention to provide a method and an apparatus in which a system for applying vibration in two directions is used to permit cutting work on a hard and brittle material to slice it into thin pieces with still higher efficiency and still higher precision than the previous improvement mentioned in the foregoing.

Briefly stated, a feature of the present invention resides in that, while a small-amplitude vibration is imparted to a material to be cut concurrently and in parallel with a reciprocating motion which is imparted also to the material in directions parallel to the cutting edge of a flat cutting tool, a small vibration is further imparted to the material in synchronism with the above-stated small-amplitude vibration in the direction in which a cutting work proceeds into the material.

The method according to the present invention gives much better results than the above-stated inventions disclosed in the precedent patent applications Japanese patent application Nos. 52-81190 and 53-161780. In accordance with the invented method, a hard and brittle material can be sliced with a high degree of precision and high work efficiency. A cutting apparatus according to the principle of the invented method can be manufactured without any particular increase in cost despite the high precision and high efficiency thereof. Accordingly, with the apparatus, work on a hard and brittle material required for a semi-conductor device, a watch, a measuring instrument or the like can be carried out at a low cost.

These objects, features and advantages will become apparent from the following detailed description of preferred embodiments thereof taken in connection with the accompanying drawings.

DETAILED DESCRIPTION OF PREFERRED EMBODIMENTS

Figure 1:
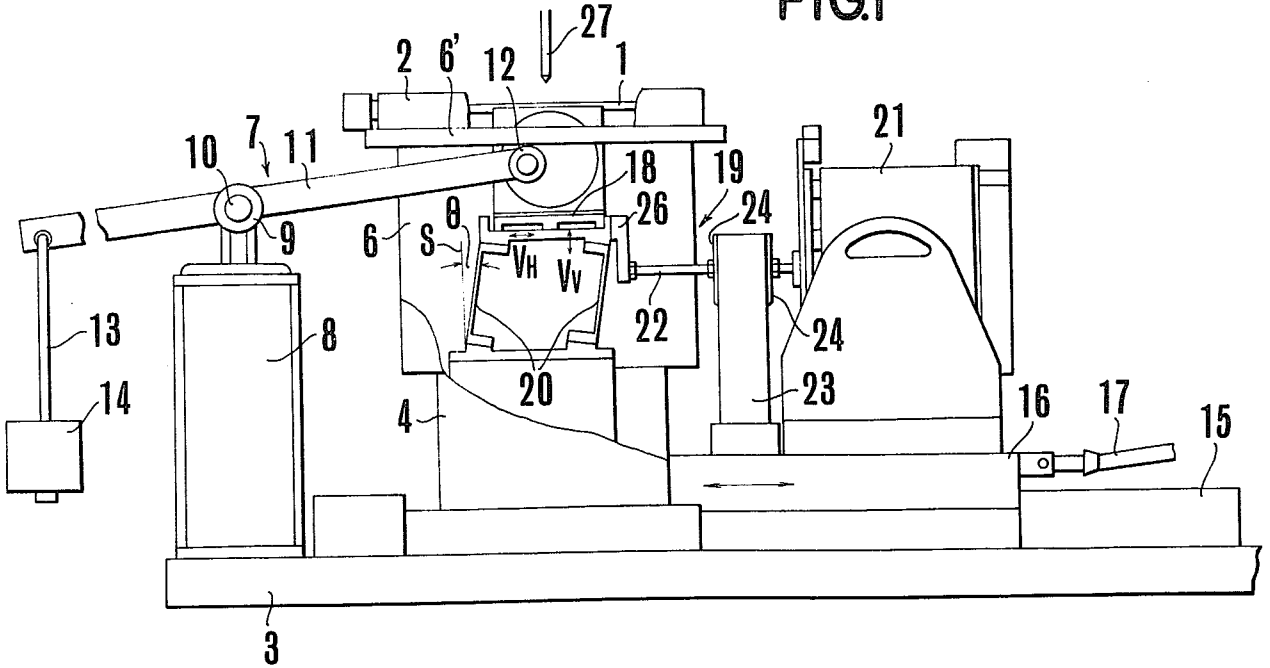
FIG. 1 is a schematic side view showing an embodiment of the invention.
Figure 2:
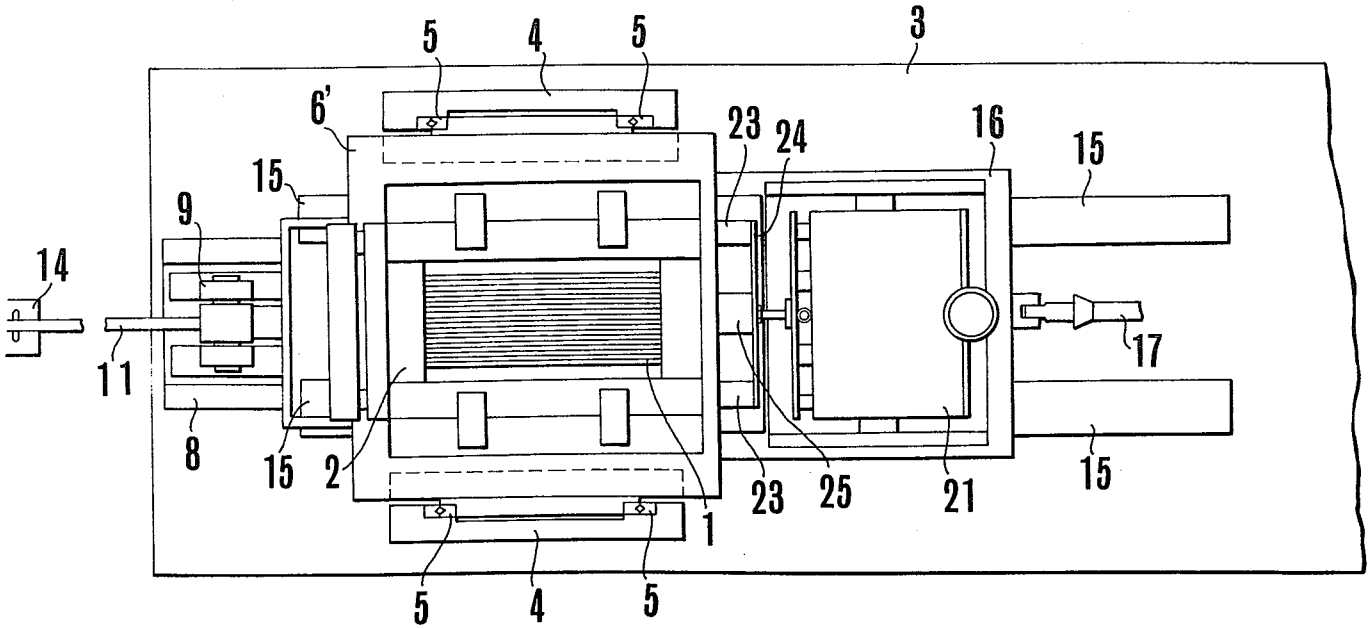
FIG. 2 is a plan view of the same.
Figure 3:
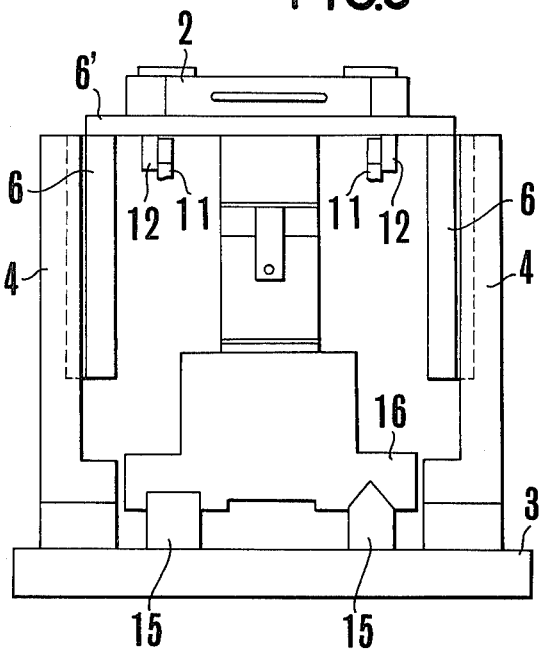
FIG. 3 is a front view of the same.

An embodiment example of the present invention is as shown in FIGS. 1 through 3. Referring to these drawings, a strip-shaped flat cutting tool 1 consists of a plurality of cutting edges which are stretched and secured to a square tool frame 2 by suitable means called spacers (or distance pieces) with even spacing and in parallel with each other. A pair of guide supports 4 are erected on a base 3 as shown in FIG. 3. The tool frame 2 is disposed on and fixed to the upper surface of a tool frame fixing plate 6' serving as the top plate of a gate-shaped frame 6 which are guided to be movable up and down through cross roller ways respectively arranged on the guide supports 4. The tool frame 2 is thus arranged into one unified body with the gate-shaped frame 6 and arranged to move downward along the guide supports 4 if there is no support for their weight. To support the tool frame 2 and to adjust the cutting pressure and speed, there is provided a work pressure adjustment mechanism 7 on the base 3. The work pressure adjustment mechanism 7 essentially consists of (i) a pin 10 rotatably supported on a bearing 9 of a support 8 which is disposed on the base 3; (ii) a yoke-like lever 11 which has the middle part thereof secured to the pin 10; (iii) a receiving roller 12 rotatably attached to one end of the lever 11; (iv) a weight receiving rod 13 suspended from the other end of the lever 11; and (v) a weight 14 disposed on the lower end flange of the weight receiving rod 13. This work pressure adjustment mechanism 7 is arranged not only to support the total weight of the tool frame 2 and the gate-shaped frame 6 but also to permit adjustment of the cutting pressure and speed of the flat cutting tool 1 through adjustment of the weight of the weight 14. A tool frame fixing plate 6' is supported from below by the receiving roller 12. The arrangement is such that the cutting pressure and speed which are inversely proportional to the weight of the weight 14 are imparted to the flat cutting tool 1 through the tool frame 2. Further, in the alternative arrangement of the work pressure adjustment mechanism, the tool frame 2 and the gate-shaped frame 6 may be hung by means of a rope; and the rope is guided downward through a constant pulley or the like with the weight attached to the lower end of the rope. With the work pressure adjustment mechanism arranged in this way, the cutting pressure can be kept constant even in the case of a large cutting extent into the material to be cut, so that precision cutting work can be carried out more advantageously.

On the base 3, there are provided guide rails 15 which extend in parallel with the flat cutting tool 1. A slider 16 which is arranged to carry the material to be cut is provided on these rails 15. The slider 16 is connected to a reciprocating motion mechanism, which is not shown in the drawings, through a connecting rod 17. The reciprocating motion mechanism is arranged to cause the slider 16 to make a reciprocating motion over the rails 15 at a predetermined cycle of, for example, about 2 Hz at the most and with a stroke length of, for example, about 150 to 200 mm. On the slider 16, there are provided a pair of plate springs 20 which are erected on the slider 16, in a slanting manner relative to a vertical plane S, in parallel with each other. The plate springs 20 form part of a vibration mechanism 19 which forms a system for applying vibration in two directions and serves as support member for a working material mounting mount 18. The system for applying vibration in two directions will be further described hereinafter. The mount 18 for the material to be cut is secured to the parallel plate springs 20. A material M which is to be cut is a hard, brittle material such as a silicon ingot is rigidly secured to the upper surface of the mount 18. The silicon ingot is generally in a cylindrical shape. To prevent the edge portion of the material from cracking during the cutting work thereon, the outside of the silicon ingot material is bonded with fine glass powder and an adhesive and is prepared into a square sectional shape as shown in the drawings.

The material mounting mount 18 is connected through an elastic connection rod 22 to a vibration exciter 21 which is fixedly disposed on the slider 16. The vibration exciter 21 is arranged to impart a small-amplitude vibration which is in the same direction as the direction of the reciprocating motion of the slider 16 to the mount 18 and the material M to be cut. To effect this impartment of vibration, the elastic rod 22 which horizontally protrudes from the vibration exciter 21 pierces through a block 25 disposed in the middle parts of parallel springs 24 provided between fixed support posts 23 for the purpose of stabilizing the amplitude of the vibration. The elastic rod 22 is tightened and fixed by means of nuts. The fore end part of the rod 22 is secured by a nut to a connecting plate 26 which is secured to the mount 18. When the mount 18 makes a composite vibration resulting from a horizontal small-vibration and a vertical small-vibration as will be described hereinafter, this structural arrangement ensures that the vertical vibration is absorbed by the deflection of the elastic connecting rod 22 to prevent it from affecting the vibration exciter 21. The frequency of the small-vibration of the vibration exciter 21 is, for example, 20 to 200 Hz and the maximum amplitude thereof is about 1.5 mm.

The parallel pair of plate springs 20 which serve as support members for supporting the material mounting mount 18 constitute part of the vibration mechanism 19 of the system for applying vibrations in the direction of cutting into the material M (or vertical directions) and in the direction of the reciprocating motion of the slider 16 (or horizontal directions). The springs 20 cooperate with rod 22 to generate this motion. In this particular embodiment, these plate springs 20 are erected on the slider 16 in a state of slanting as much as a given angle $\theta$ to a vertical plane S which is perpendicular to the direction in which the slider 16 makes the reciprocating motion. With the parallel pair of plate springs 20 thus arranged aslant under a no load condition, there takes place a vertical vibration Vv at the upper ends of the parallel plate springs 20 when a horizontal vibration Vh is given by the vibration exciter 21. This results in a vibration which acts on the material M being cut in the direction of cutting into the material M thereby to accelerate a cutting operation as will be described hereinafter. There is provided a nozzle 27 for supplying a suspension containing cutting powder grains in a suspended state therein (a grain suspension) to the cutting part of the material M. The nozzle 27 is connected to a work liquid supply mechanism which is not shown. Next, the cutting operation of the cutting apparatus and the operations of the components arranged as described above will be understood from the following description.

First, the tool frame 2 is kept in a state moved upward by attaching the weight 14 which is heavier than the total weight of the tool frame 2 and the gate-shaped frame 6 to the weight receiving rod 13 of the cutting pressure adjustment mechanism 7. A material M to be cut is then clamped onto the mount 18. Following that, the weight of the weight 14 is lessened to allow the tool frame 2 to descend until the flat cutting tool 1 comes to abut on the material M with a predetermined degree of pressure thereon. The reciprocating motion mechanism which is not shown is started to cause the slider 16 to make a reciprocating motion along the rails 15. Concurrently with this, the vibration exciter 21 is operated to give a small-amplitude vibration of the horizontal direction the the material mounting mount 18. Meanwhile, the work liquid supply mechanism which is not shown is operated to pour the grain suspension from the nozzle 27 to the cutting part of the material. The horizontal vibration imparted to the mount 18 and the reciprocating motion of the slider 16 caused by the reciprocating motion mechanism impart a superimposed motion to the material M in the direction parallel to the cutting edge of the flat cutting tool 1. As a result, the flat cutting tool 1 makes a reciprocating motion in parallel with the cutting edge thereof in relation to the material M to be cut, the reciprocating motion being performed at a predetermined length of stroke. At the same time, the vibrating mechanism 19 (consisting of a parallel slanting pair of plate springs 20 and the rod 22) which forms the two-directional vibration applying system produces a vibration in the cutting direction. This vibration (in the cutting direction) causes an intermittent cutting motion to take place according to the frequency of this vibration.

The grain suspension which is poured into cutting gaps is vibrated not only in the direction parallel to the cutting edge of the flat cutting tool but also in the direction of cutting into the material M (or in the vertical direction). Therefore, the flat cutting tool moves along these vibrating directions to effect cutting into the material M.

Results of experiments conducted in accordance with the method of the present invention indicate that cutting work can be accomplished with higher efficiency by the invented method than in accordance with the aforementioned method of the prior art disclosed in Japanese patent application No. 53-161780. The results of experiments also indicate that the adoption of the invented method results in a high degree of precision of cut surfaces. This is attributable to the vibrations applied in the horizontal and vertical directions. In addition to the effect resulting from the increase in the relative speed component in the lateral direction attainable by the method as disclosed in Japanese patent application No. 53-161780, this vibration system of the present invention gives a vibration component in the vertical cutting direction. This vibration component brings about a hammering effect of the cutting powder grains on the cutting face depending on the value of an impulse arising between the flat cutting tool and the cutting powder grains. This hammering effect accelerates the rolling movement and crushing of the cutting powder grains of an asterisk-like shape.

It has been found through experiments that the optimum slanting angle $\theta$ of the slanting parallel plate springs is between 5° and 15° or thereabout. A slanting angle exceeding 20° results in excessive vibration acceleration which causes the slurry supplied from above to spatter and thus rather hinders effective cutting powder grains from entering the part being cut. Further, a slanting angle exceeding 45° not only lowers work efficiency but also accelerates a vibration due to collision between the flat cutting tool and the material to be cut. Where a high degree of precision is required, the excessive angle renders the rigidity of the apparatus insufficient and causes distortion (deflection) of the flat cutting tool in the vertical direction thus resulting in an increase in cutting allowance, which would present a problem for practical application of the apparatus. In addition to these problems, an excessive slanting angle results in buckling of the parallel plate springs due to working pressure (or a working load). In such a case, an increase in the strength of the plate springs must be taken into consideration. In view of these problems, the above-stated range of slanting angle is considered most preferable.

In accordance with the method of the invention, work efficiency attainable is about several times as high as the efficiency attainable by the conventional cutting method that only gives a reciprocating motion without imparting any vibration to the cutting tool (tentative calculation). Besides, the invented method gives a lapping effect of the cutting powder grains resulting in a beautiful cut surface which obviates the necessity of a finish lapping process. Further, the arrangement of the invention to impart the vibration and the cutting motion to the material to be cut, which is of a smaller mass than the cutting tool frame, permits reduction in size of the cutting apparatus. Therefore, this results in less energy consumption.

The embodiment described in the foregoing employs the vibration mechanism 19 forming the two-directional vibration applying system which consists of the slanting parallel plate springs for generating a vibration in the direction of cutting into the material and means for moving the springs. In FIG. 1, the rod 22 acts as part of a first vibration mechanism for horizontal motion and also a second vibration mechanism for the vertical motion. The vibration mechanism of this type is simple in structure and is inexpensive. Besides, it is another advantage that, with the mechanism being mechanically coupled with the vibration exciter 21, the former gives a vertical vibration of the phase which is the same as the horizontal vibration of the vibration exciter 21 and is in synchronism therewith.

Figure 4:
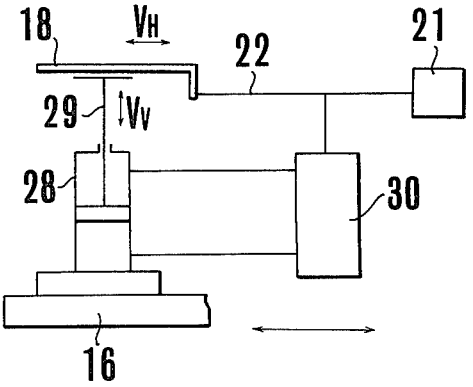
FIGS. 4 through 6 are schematic views showing partial modifications of the embodiment of the invented apparatus.
Figure 5:
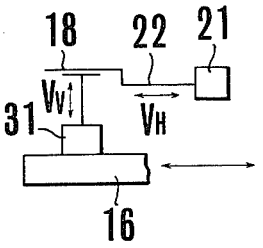
Figure 6:
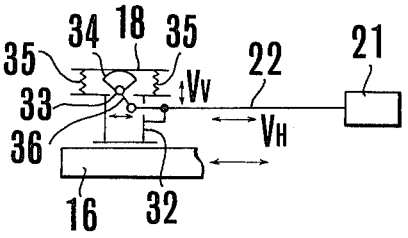

However, the apparatus according to the invention is not limited to the use of a vibration mechanism of the abovementioned type for imparting horizontal and vertical vibrations to a material to be cut. It should be understood that the principle of the invented method may be embodied in any structural arrangement that is equivalent to the embodiment described in the foregoing. FIGS. 4 through 6 illustrate different arrangements for vibrating a material to be cut.

In the case of FIG. 4, the material mounting mount 18 is slidably arranged on a rod 29 of an electro-hydraulic vibration imparter 28. A work valve 30 which is provided on the electro hydraulic vibration imparter 28 is opened and closed in synchronism with a horizontal vibration of the vibration exciter 21 to cause thereby a synchronized vibration to take place at the mount 18 in the direction of cutting into the material.

In another arrangement which is shown in FIG. 5, an electromagnetic vibrator 31 is disposed on the slider 16. The mount 18 is slidably mounted on this electromagnetic vibrator 31. The vibrator 31 is electrically connected to the vibration exciter 21 to synchronize the vibrations produced by the two with each other.

In the case of FIG. 6, a sector cam 34 is pivotally attached through a pin 33 to the top of a support 32 slidably erected on the slider 16. The mount 18 is pressed by springs 35 into contact with the sector cam 34. Meanwhile, a link 36 which is provided for the purpose of rotating the pin 33 is connected to the connecting rod 22 of the vibration exciter 21. Accordingly, the sector cam 34 moves in association with the vibration exciter 21. The horizontal vibration produced by the vibration exciter 21 is transmitted to the support 32 and the sector cam 34. A horizontal vibration and a vertical vibration are thus simultaneously applied to the mount 18.

It will be obvious also to those skilled in the art that the work pressure adjustment mechanism 7 of the aforementioned embodiment may be likewise replaced with many modifications without departing from the spirit of the invention. The weight balance system illustrated in the drawings may be replaced, for example, with a water balance system using a water tank equipped with a valve, or with a system in which the tool frame is arranged to be supported directly by a hydraulic cylinder or a hydraulic ram.

Such being the arrangement of the invention, hard, brittle materials such as ceramics, silicon materials or rock crystal materials can be accurately cut with a high degree of efficiency. Further, the cutting method and apparatus according to the invention permit the manufacture of silicon wafers, crystal oscillators, etc. at a lower cost than the methods of the prior art.

What we claim is:

1. A method for cutting a hard and brittle material, wherein the hard and brittle material to be cut is cut with a strip-shaped flat cutting tool used in combination with a system for applying vibration in two directions, comprising:

imparting to the material to be cut a reciprocating motion of a desired length of stroke in parallel with the cutting edge of the flat cutting tool and at a selected low frequency;

imparting a first small-amplitude, low frequency vibration to the material to be cut in a direction parallel to the cutting edge, with an amplitude which is less than the desired length of stroke and a frequency which is above the selected low frequency;

imparting, at the same time as the first vibration, a second small-amplitude vibration to the material in a direction parallel to the cutting direction of the cutting tool into the material, with an amplitude which is less than the desired length of stroke and a frequency which is substantially the same as the frequency of the first vibration;

applying a desired cutting pressure to the flat cutting tool in the direction of cutting to the material; and carrying out cutting work on the material while supplying a cutting abrasive grain fluid to a part of the material to be cut.

2. A cutting apparatus with a system for applying vibration in two directions for cutting a hard and brittle material comprising in combination:

a tool frame to which a strip-shaped flat cutting tool is secured in a stretched state;

a guide mechanism for guiding said tool frame in the direction in which the flat cutting tool cuts into said material;

a work pressure adjustment mechanism for adjusting cutting pressure to be exerted on said flat cutting tool through said tool frame and the cutting speed of the cutting tool;

a mount for mounting the hard and brittle material to be cut;

a slider which carries said mount and is slidable in directions parallel to the cutting edge of said flat cutting tool;

a reciprocating motion mechanism for imparting a reciprocating motion of relatively long stroke to said slider in said directions parallel to the cutting edge of the flat cutting tool;

a first and second vibration component applying mechanism mounted on said slider for applying a first small-amplitude vibration to said mount in a direction parallel to the reciprocating motion, which reciprocating motion is made in a longer period than said first small amplitude vibration, and for simultaneously applying a second small-amplitude vibration to said mount in a direction in parallel with the direction in which the flat cutting tool cuts into the material; and a work liquid supply mechanism for supplying a abrasive grain fluid to the cutting part of said material being cut.

3. An apparatus according to claim 2 wherein said first and second vibration component applying mechanisms serve combined functions as supporting members carrying said mount for mounting said material to be cut; and include a parallel pair of plate springs which are erected aslant on said slider with their faces respectively slanting at a predetermined angle relative to a vertical line.

4. An apparatus according to claim 3 wherein said predetermined angle is from 5° to 15°.

5. An apparatus according to claim 2 wherein said first and second vibration component applying mechanism comprises first vibration applying means for applying said first vibration and second vibration applying means for applying said second vibration, said second vibration applying means being connected to said first vibration applying means so that said first and second vibrations are synchronized.

* * * * *